US006894258B2

(12) United States Patent
Chun

(10) Patent No.: US 6,894,258 B2
(45) Date of Patent: May 17, 2005

(54) MICROWAVE OVEN AND METHOD OF CONTROLLING THE SAME

(75) Inventor: Yun-Bong Chun, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/671,635

(22) Filed: Sep. 29, 2003

(65) Prior Publication Data

US 2004/0134903 A1 Jul. 15, 2004

(30) Foreign Application Priority Data

Jan. 11, 2003 (KR) ..... 10-2003-0001855

(51) Int. Cl.[7] ..... H05B 6/68
(52) U.S. Cl. ..... 219/708; 219/702
(58) Field of Search ..... 219/708, 702, 219/703, 393, 704, 391, 714, 696, 720, 506; 118/13; 177/1, 210 C, 245

(56) References Cited

U.S. PATENT DOCUMENTS 4,724,292 A * 2/1988 Ichikawa ..... 219/708
4,914,277 A * 4/1990 Guerin et al. ..... 219/506
5,780,821 A * 7/1998 Choi et al. ..... 219/703
6,021,736 A * 2/2000 Ciaramita ..... 118/13

FOREIGN PATENT DOCUMENTS

JP 7-49263 2/1995
KR 1019960011448 * 8/1996
KR 2001000431 A * 1/2001 ..... F24C/7/02

* cited by examiner

*Primary Examiner*—Quang T. Van
(74) *Attorney, Agent, or Firm*—Staas & Halsey LLP

(57) ABSTRACT

A microwave oven, and method of controlling the same, stores a weight of food in an external memory of the microwave oven through a simple manipulation of pressing a hold key, and applies the stored weight of the food for calculation of a cooking time. The microwave oven of the present invention may perform cooking by calculating a cooking time based on the weight of the food temporarily stored in an internal memory even if a setting operation using the hold key is not performed. Further, the present invention is advantageous in that it calibrates a zero point to calculate the cooking time, increasing a cooking performance. The microwave oven performs initialization by deleting the stored weight of the food if a cooking start key is not pressed within a set time after the weight of food is measured, thus preventing a malfunction of the microwave oven.

24 Claims, 7 Drawing Sheets

MICROWAVE OVEN AND METHOD OF CONTROLLING THE SAME

CROSS-REFERENCE TO RELATED APPLICATION

This application claims the benefit of Korean Application No. 2003-1855, filed Jan. 11, 2003, in the Korean Industrial Property Office, the disclosure of which is incorporated herein by reference.

BACKGROUND OF THE INVENTION

1. Field of the Invention

The present invention relates, in general, to a microwave oven and method of controlling the same, which performs cooking by setting cooking times depending on weights of foods to be cooked.

2. Description of the Related Art

Generally, a microwave oven, which performs cooking by setting cooking times depending on weights of foods, uses a method of directly receiving weight information of the foods from a user, and a method of measuring the weights of the foods using a weight sensor. The former method is inconvenient in that the user has to measure the weight of the food and input the measured weight of the food.

In the latter method, a weight sensor is arranged below a cooking tray installed in a cooking cavity to measure the weight of the food on the cooking tray, and a cooking time is calculated depending on the measured weight of the food. If the user wants to know only the weight of the food rather than cooking the food by using the microwave oven, for example, the user has to open a door of the microwave oven, place the food into a cooking cavity of the microwave oven, measure the weight of the food, remove the food from the cooking cavity of the microwave oven, and close the door in order to know the weight of the food.

With the inconveniences above taken into consideration, there has been proposed a method of mounting a weight sensor on a top of a body of a microwave oven, and measuring the weight of the food outside the cooking cavity.

However, the above method is inconvenient in that when the weight of the food is measured outside the cooking cavity, and the user puts the food into the cooking cavity the user has to input the weight of food so as to perform cooking after memorizing the weight of the food. Therefore, it is required to store the measured weight of the food and perform cooking depending on a cooking time that corresponds to the stored weight of the food.

Further, in the above method, while a container filled with food is put on a cooking tray, the weight of the food is measured. Therefore, even if the weight of the same food is measured, the measured weight of the food varies according to a weight of a container, making it difficult to accurately measure the weight of the food. As a result, the cooking time calculated based on the weight of the food is also inaccurate, deteriorating an overall cooking performance.

SUMMARY OF THE INVENTION

Accordingly, it is an aspect of the present invention to provide a microwave oven and method of controlling the same, which may perform cooking by conveniently storing a weight of food and calculating a cooking time to correspond to the stored weight of the food when the cooking starts.

It is another aspect of the present invention to provide a microwave oven and method of controlling the same, which may accurately sense a weight of food by calibrating a zero point at a time of measuring the weight of the food.

Additional aspects and advantages of the invention will be set forth in part in the description which follows and, in part, will be obvious from the description, or may be learned by practice of the invention.

The foregoing and/or other aspects of the present invention are achieved by providing a microwave oven, including a weight sensing unit to sense a weight of food, a memory to store weight information of the food, and an input unit to set a mode to measure the weight of the food and a mode to store the measured weight of the food. The microwave oven also includes a controller to store the weight of the food measured through the weight sensing unit in the memory when the weight measurement and storage modes are set through the input unit, and to calculate a cooking time depending on the weight of the food stored in the memory when cooking is performed.

The foregoing and/or other aspects of the present invention are achieved by providing a method of controlling a microwave oven having a weight sensing unit to sense a weight of food. The method includes determining whether a weight measurement mode is set to measure a weight of the food, determining whether a weight information storage mode is set to store weight information of the food if the weight measurement mode is set, and storing the weight of the food measured using the weight sensing unit if the weight information storage mode is set.

BRIEF DESCRIPTION OF THE DRAWINGS

The above and/or other aspects and advantages of the invention will become apparent and more readily appreciated from the following description of the preferred embodiments, taken in conjunction with the accompanying drawings of which:

FIGS. 2A and 2B are views showing operations of measuring a weight of food using a weight sensing device employed in the microwave oven of FIG. 1, wherein FIG. 2A shows an operation of measuring a weight of a container, and FIG. 2B shows an operation of measuring the weight of the food in the container;

DETAILED DESCRIPTION OF THE PREFERRED EMBODIMENTS

Figure 1:
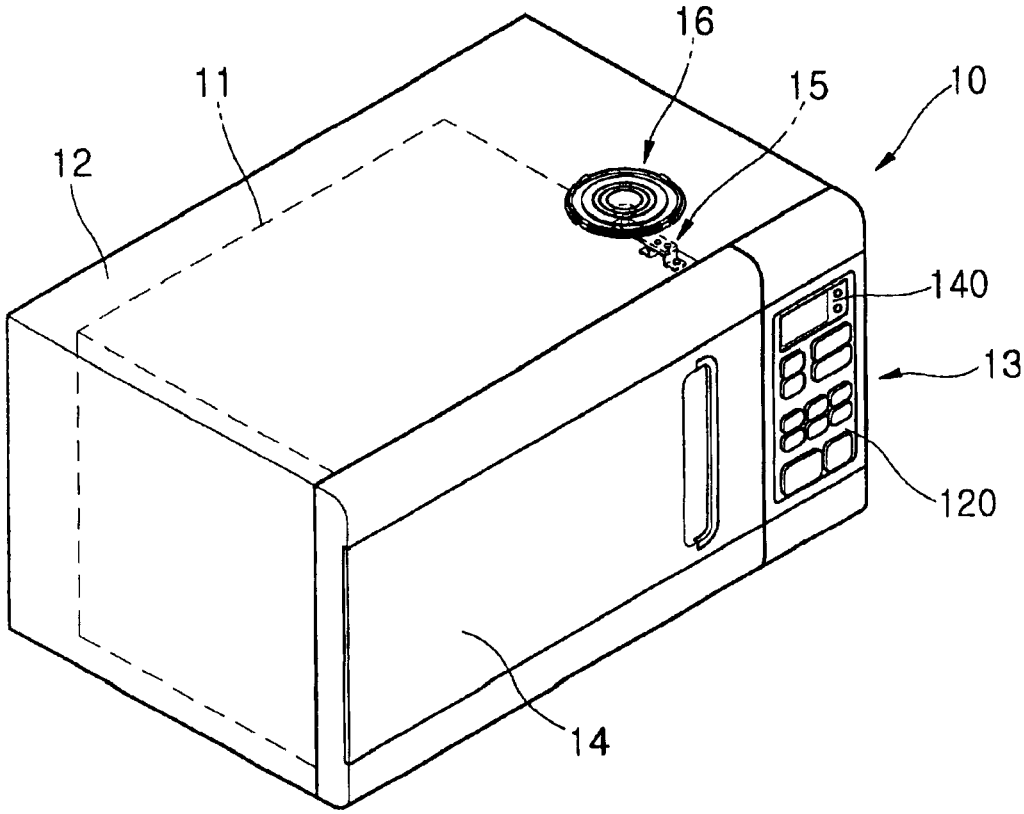
FIG. 1 is a perspective view showing an external shape of a microwave oven, according to an embodiment of the present invention.

Reference will now be made in detail to the present preferred embodiments of the present invention, examples of which are illustrated in the accompanying drawings, wherein like reference numerals refer to like elements throughout.

FIG. 1 is a perspective view showing an external shape of a microwave oven equipped with a weight sensing device, according to an embodiment of the present invention. In FIG. 1, an example is shown in which the weight sensing device is installed in an upper portion of a body of the microwave oven to measure a weight of food outside a cooking cavity.

The microwave oven of the present invention includes a body 10 having an internal casing 11 to provide a cooking cavity therein, and an external casing 12 provided to enclose an outside of the internal casing 11 while being spaced apart from the internal casing 11. A control panel 13 provided with an input unit 120 and a display unit 140 is mounted at a portion on a front of the body 10. A door 14 rotatably attached to the body 10 is mounted at another portion on the front of the body 10 to selectively open and close the cooking cavity. A weight sensing unit 15 is installed in an upper portion of the body 10 to sense the weight of the food, and a platform unit 16 is mounted on the weight sensing unit 15 to put a container filled with the food on the platform unit 16.

Figure 2A:
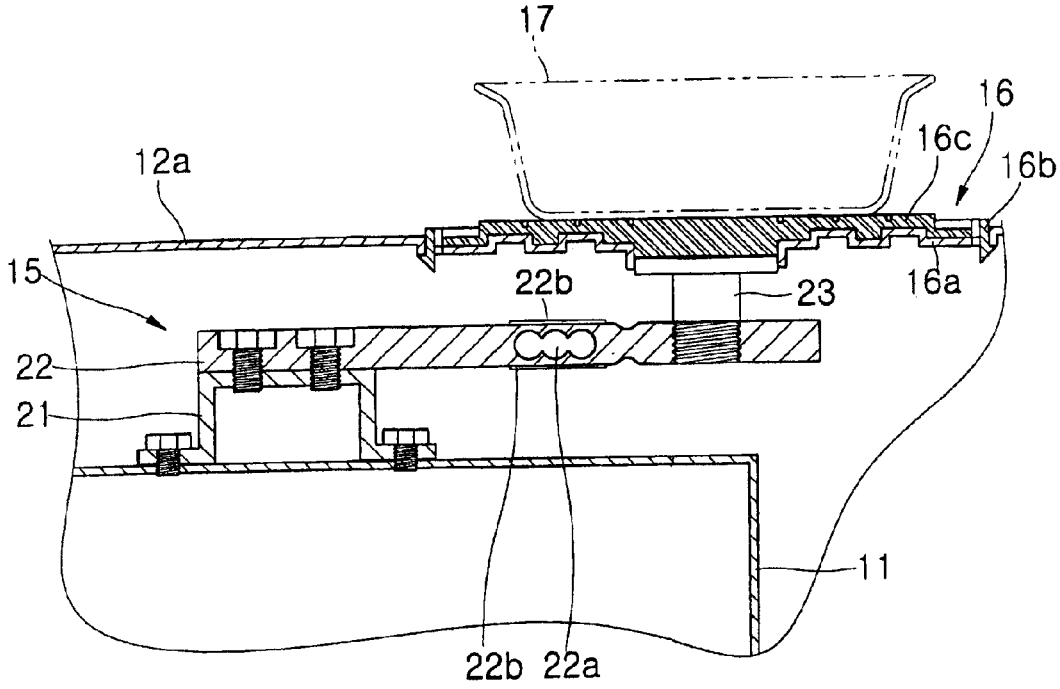
Figure 2B:
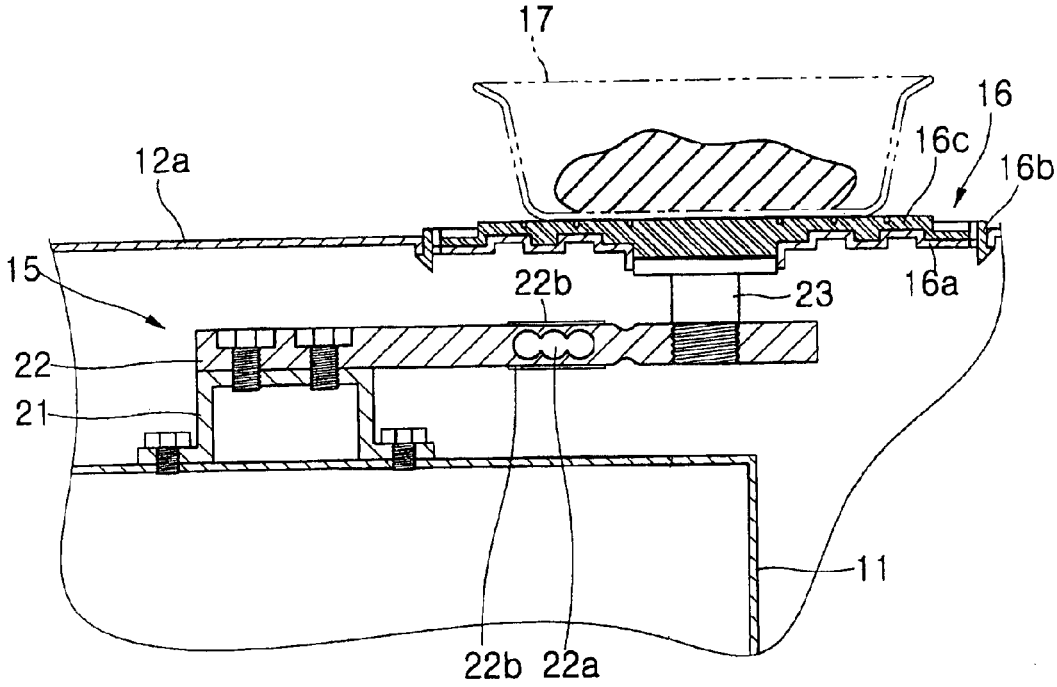

Referring to FIGS. 2A and 2B, the weight sensing unit 15 includes a weight sensor 22, and a support bracket 21 to support the weight sensor 22. The weight sensor 22 measures a weight of an object to be put on the platform unit 16 provided on the external casing 12.

The platform unit 16 includes a platform base 16*a* integrated with an upper sheet 12*a* of the external casing 12, a rubber seat 16*c* to provide a plate used to receive thereon the object, the weight of which is to be measured, and a locking ring 16*b* to fix the rubber seat 16*c* to the platform base 16*a*.

The weight sensor 22 is constructed in such a way that one end thereof is screwed to the support bracket 21, a shaft 23 is vertically fixed to a free end of the weight sensor 22 to receive force applied to the upper sheet 12*a* of the external casing 12, at least one heat dissipating hole 22*a* is included in the weight sensor 22 to allow the free end of the weight sensor 22 to be easily bent and protected against heat, and sensing elements 22*b* are mounted on the top and bottom surfaces of a center portion of the weight sensor 22. As the free end of the weight sensor 22 is bent, the sensing element 22*b* on the top surface of the weight sensor 22 is expanded and the sensing element 22*b* on the bottom surface of the weight sensor 22 is contracted, so that internal resistances of the sensing elements 22*b* vary. The sensing elements 22*b* on the top and bottom surfaces of the weight sensor 22 apply a weight sensing signal to correspond to the varied resistances to a controller, which will be described later.

Figure 3:
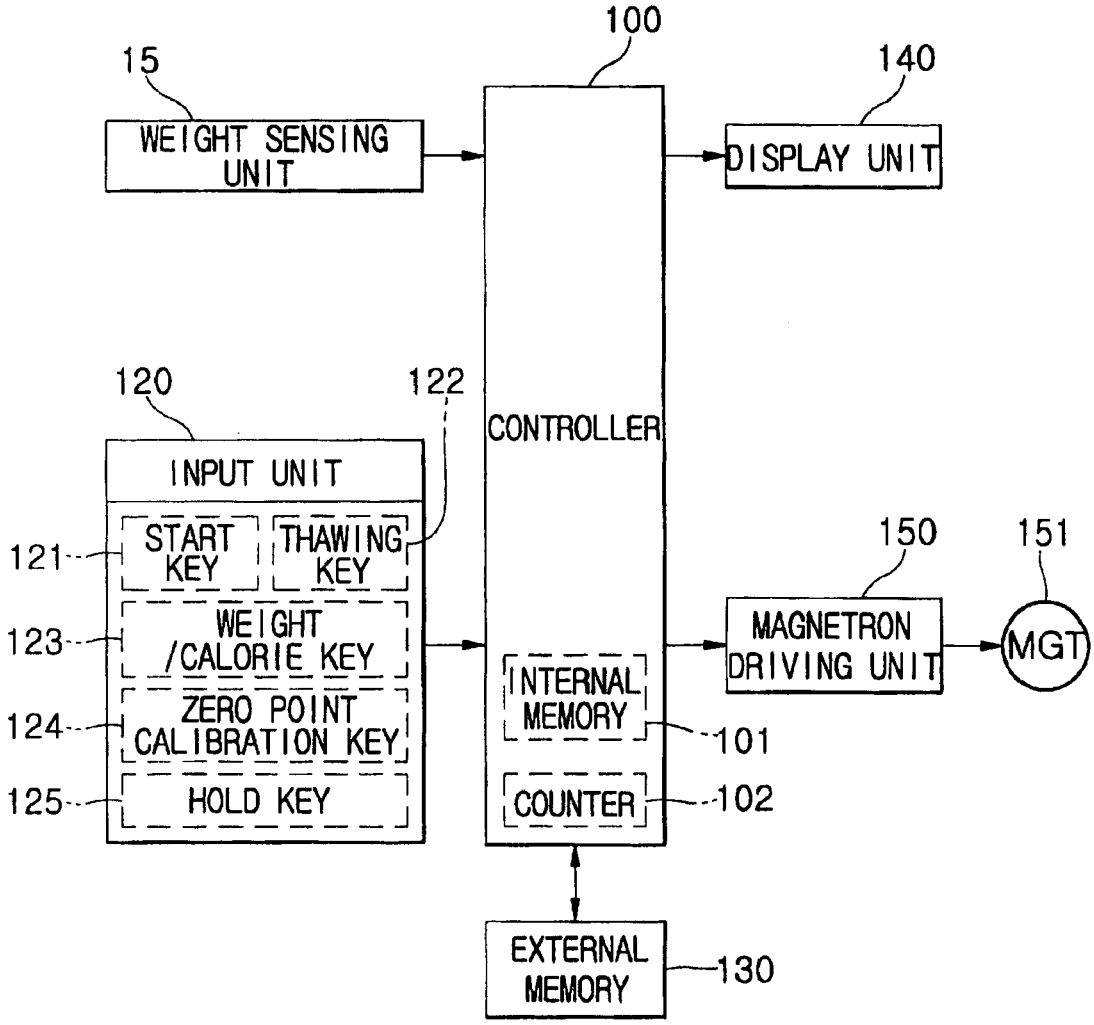
FIG. 3 is a control block diagram of the microwave oven.

FIG. 3 is a control block diagram of the microwave oven of the present invention.

The microwave oven includes a controller 100 that controls an entire operation of calculating a cooking time depending on the weight of the food to perform cooking.

An input terminal of the controller 100 is connected to both the weight sensing unit 15 and the input unit 120, and an output terminal thereof is connected to both the display unit 140 and a magnetron driving unit 150 to drive a magnetron 151. The controller 100 includes an internal memory 101 to temporarily store data and a counter 102 to count a predetermined period of time. In this embodiment, a Random Access Memory (RAM) is used as the internal memory 101.

The weight sensing unit 15 includes the weight sensor 22, and outputs a weight sensing signal to correspond to a measured weight of the food to the controller 100.

The input unit 120 includes keys to allow a user to set cooking conditions. For example, the input unit 120 has a cooking start key 121 to set a cooking start, a thawing key 122 to set a thawing mode, a weight/calorie key 123 to set a weight or calorie measurement mode, a zero point calibration key 124 to set a calibration point to zero and a hold key 125 to set a mode of storing the weight of the food.

A memory device capable of storing data even after power is turned off is used as an external memory 130. In this embodiment, an Electrically Erasable and Programmable Read Only Memory (EEPROM) is used as the external memory 130.

The display unit 140 displays cooking states according to progress of cooking and menu information to set various cooking conditions, and further displays a cooking time, the weight of the food, a calorie content of the food, etc.

The magnetron driving unit 150 drives the magnetron 151 based on the control of the controller 100, to perform cooking by irradiating microwaves into the cooking cavity.

The hold key 125 is used to store the weight of the food in the external memory 130 through the weight sensing unit 15. That is, after a weight measurement mode is set through the weight/calorie key 123, the weight of the food measured by the weight sensing unit 15 is displayed on the display unit 140. When the user ascertains the weight of the food and then presses the hold key 125, the measured weight of the food is stored in the external memory 130. After that, when the user puts the food into the cooking cavity and presses the cooking start key 121, a cooking time to correspond to the weight of the food stored in the external memory 130 is calculated, and the magnetron 151 is driven and controlled for the calculated cooking time, thus performing cooking.

As described above, the weight of the food may be stored through simple manipulation of pressing the hold key 125, so that the user's inconvenience of personally memorizing the weight of the food may be eliminated. Further, when the zero point is calibrated, the controller 100 stores the weight of the food in the internal memory 101. In this case, if there is a setting operation through the hold key 125, the weight of the food, which is calculated after the zero point is calibrated, is stored in the external memory 130. In addition, even though there is no setting operation through the hold key 125, the weight of the food is stored in the external memory 130 if there is a change in the weight of the food for a time greater than or equal to a reference time within a reference range.

The zero point calibration key 124 is used to set the calibration point to zero so as to measure the weight of the food excluding the weight of the container.

Figure 4:
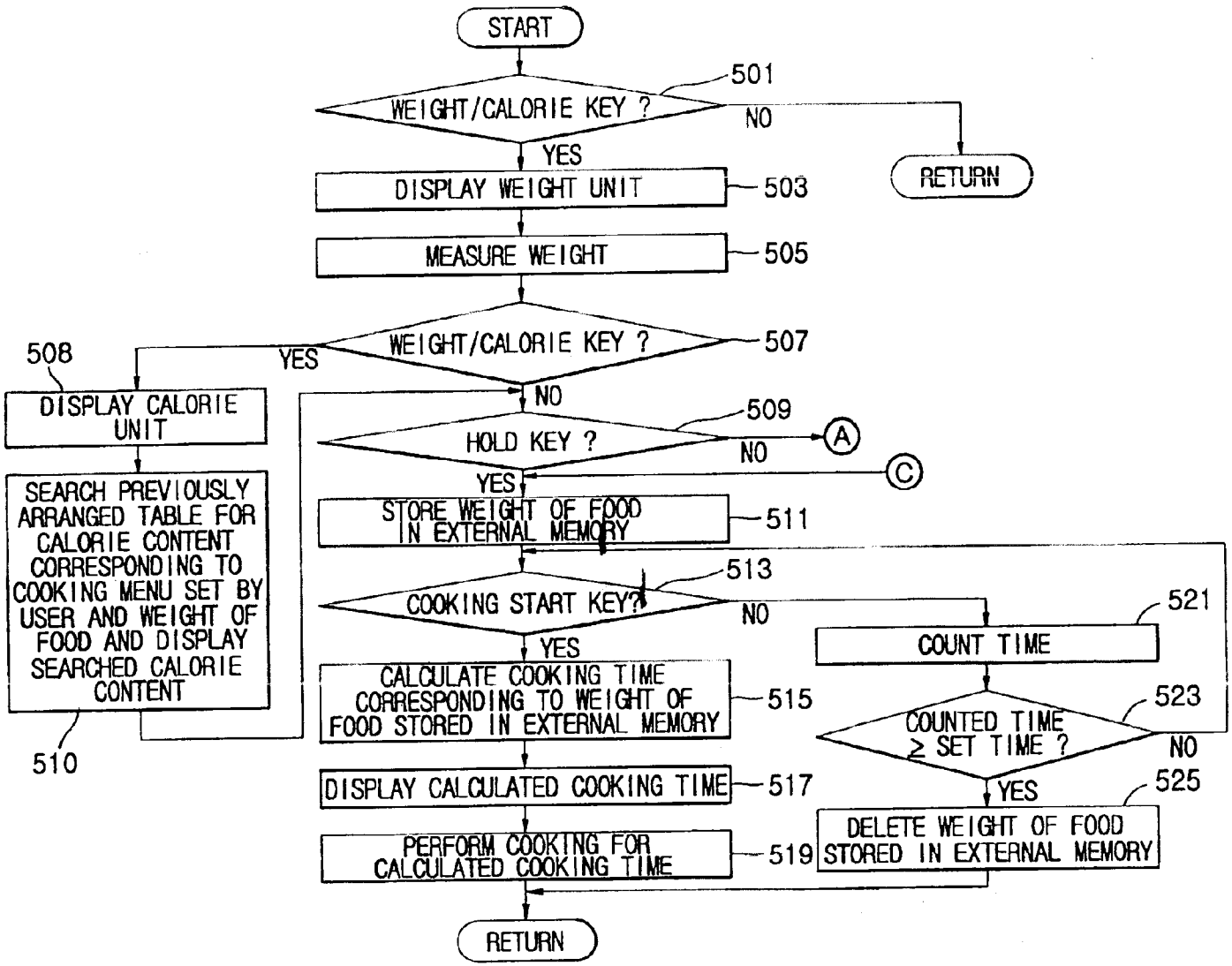
FIGS. 4 through 6 are flowcharts of a method of controlling the microwave oven.
Figure 5:
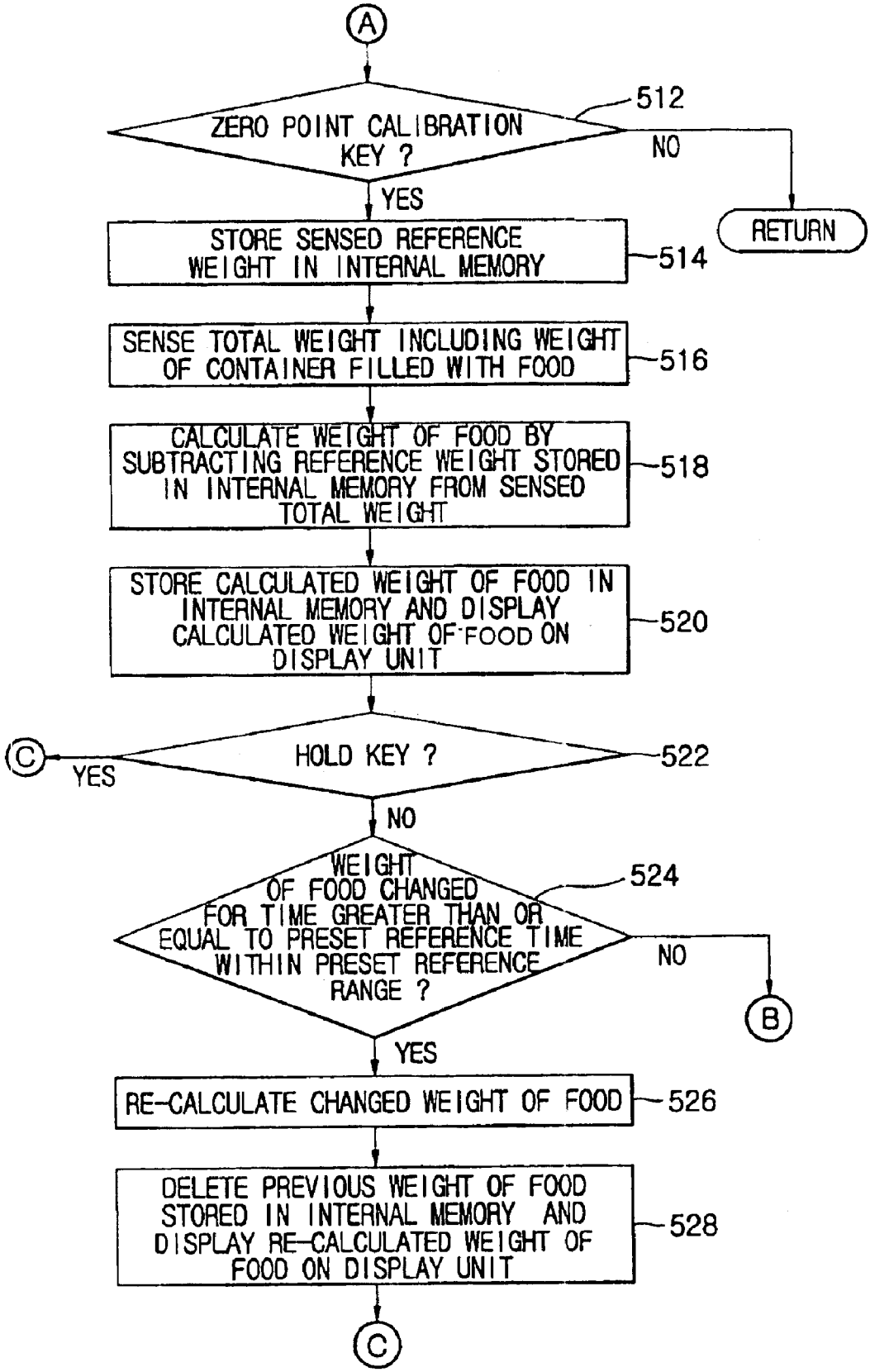
Figure 6:
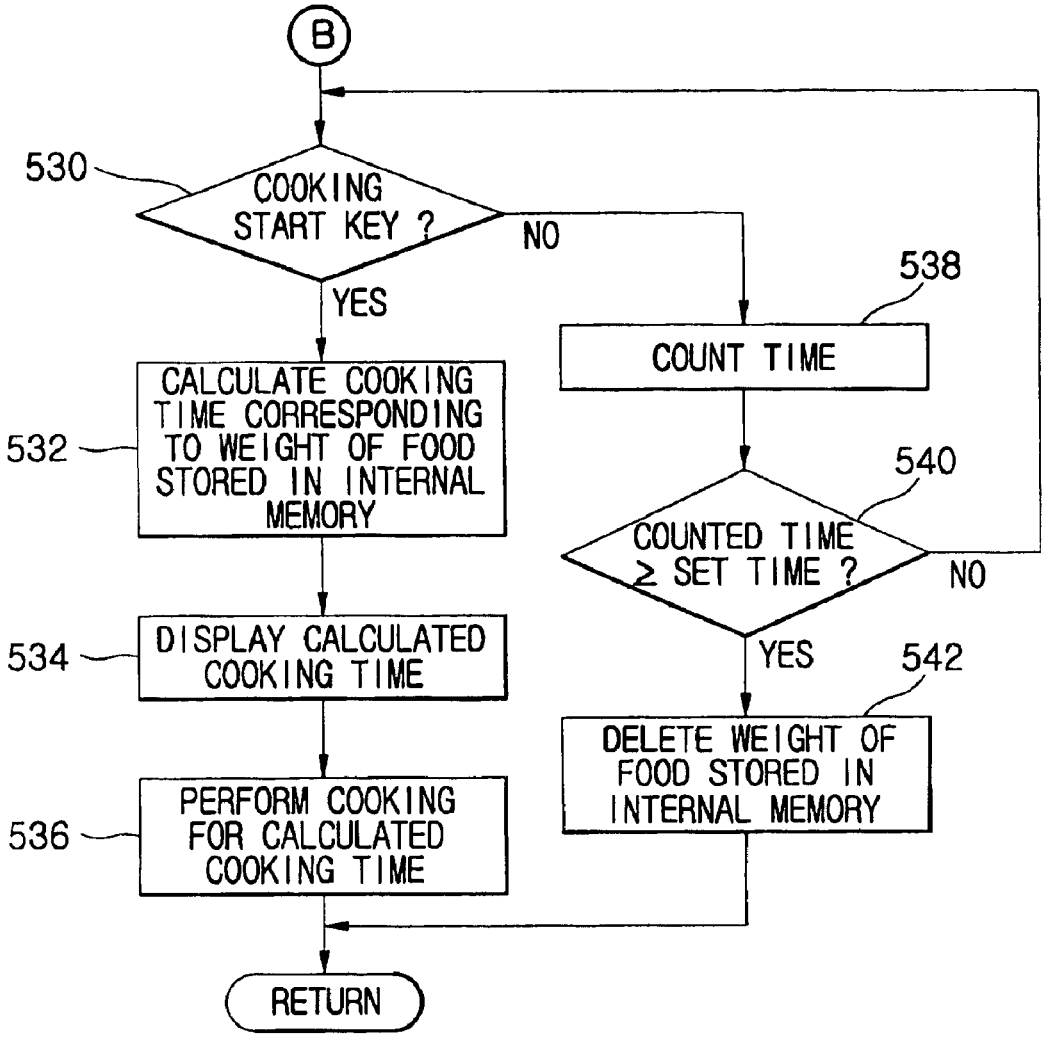

A method of controlling the microwave oven according to the present invention in light of the above construction is described in FIGS. 4 through 6.

In FIG. 4, the controller 100 determines whether the weight/calorie key 123 is pressed, in operation 501. If it is determined that the weight/calorie key 123 is pressed, a weight unit, for example, gram (g), is displayed on the display unit 140, in operation 503. The weight sensing unit 15 measures the weight of an object to be put on the platform unit 16 and outputs a weight sensing signal to the controller 100, in operation 505. In this case, if only food is put on the platform unit 16, the weight of the food is measured, while if only a container is put on the platform unit 16, the weight of the container is measured.

The controller 100 determines whether the weight/calorie key 123 is pressed again, in operation 507. If the weight/calorie key 123 is pressed again, a calorie unit, for example, kcal, is displayed on the display unit 140, in operation 508. After that, the controller 100 searches a previously arranged table for a calorie content to correspond to a cooking menu set by the user using the input unit 120 and the weight of the food, and displays the searched calorie content on the display unit 140, in operation 510.

Further, the controller 100 determines whether the hold key 125 is pressed by the user, in operation 509. If the hold key 125 is pressed, the controller 100 stores the weight of the food sensed through the weight sensing unit 15 in the external memory 130. Accordingly, the weight of the food calculated after performing the zero point calculation, as well as the weight of the food calculated without performing zero point calibration, may be stored as will be described later, in operation 511.

If the user sets a cooking menu and a cooking start together after putting the food, the weight of which has been measured, into the cooking cavity, the controller 100 determines whether the cooking start key 121 is pressed, in operation 513. If the cooking start key 121 is pressed, the controller 100 calculates a cooking time to correspond to the weight of the food stored in the external memory 130. The cooking time is calculated using equations obtained through experiments, in operation 515. That is, through numerous experiments, a numerical formula was obtained to calculate a cooking time using a variable corresponding to a weight of the food. Further, the controller 100 displays the calculated cooking time on the display unit 140, in operation 517. The controller 100 performs cooking by controlling the magnetron driving unit 150 to drive the magnetron 151 with the cooking being performed for the calculated cooking time, in operation 519.

If it is determined that the cooking start key 121 is not pressed in operation 513, the controller 100 counts a time using the counter 102, in operation 521. The controller 100 determines whether the counted time is greater than or equal to a set time, for example, 10 seconds, in operation 523. If the counted time is not greater than or equal to the set time, the controller 100 returns to the operation 513 so as to continuously count a time. If the counted time is greater than or equal to the set time, in operation 523, the controller 100 initializes the external memory 130 by deleting the weight of the food stored in the external memory 130 so as to prevent malfunction due to carelessness of the user, in operation 525. In this case, the reason for deleting the stored weight of food is to prevent cooking from being performed depending on a cooking time corresponding to the weight of food stored in the external memory 130 when the user does not put the food into the cooking cavity and presses the cooking start key 121.

In FIG. 5, if the weight/calorie key 123 is not pressed again, in operation 509, the controller 100 determines whether the zero point calibration key 124 is pressed by the user, in operation 512. If the zero point calibration key 124 is pressed, in operation 512, the controller 100 stores a sensed reference weight in the internal memory 101, in operation 514. In this case, the sensed reference weight represents the weight of a container 17 measured after the user puts only the container 17 on the platform unit 16, as shown in FIG. 2A.

After that, if the user puts the container 17 filled with food on the platform unit 16, the controller 100 senses a total weight including the weight of the container 17 in response to a weight sensing signal inputted through the weight sensing unit 15, in operation 516. Further, the controller 100 calculates the weight of the food by subtracting the reference weight stored in the internal memory 101 from the sensed total weight, in operation 518. The controller 100 then stores the calculated weight of the food in the internal memory 101 and displays the calculated weight of the food on the display unit 140, in operation 520.

Thereafter, the controller 100 determines whether the hold key 125 is pressed by the user, in operation 522. If the hold key 125 is pressed, in operation 522, the controller 100 performs the storing, in operation 511, to store the calculated weight of the food in the external memory 130.

If the hold key 125 is not pressed, in operation 522, the controller 100 determines whether the weight of the food sensed through the weight sensing unit 15 changes for a time greater than or equal to a reference time within a preset reference range, in operation 524. If it is determined that the sensed weight of the food changes for a time greater than or equal to the reference time within the preset reference range, in operation 524, the controller 100 recalculates the weight of the food in operation 526. In this case, the reference range represents a range between upper and lower limits for the sensed weight T1 of the food, for example, a range between an upper limit T1+2 and a lower limit T1-2. Further, the reference time is set to a certain time, for example, approximately two seconds.

The operation of re-calculating the weight of the food is to calculate the changed weight of the food by subtracting the reference weight from a total weight re-sensed through the weight sensing unit 15 at the present time.

The controller 100 deletes the previous weight of the food stored in the internal memory 101 and displays the re-calculated weight of the food on the display unit 140, in operation 528, and then returns to the storing operation 511 to store the re-calculated weight of the food in the external memory 130.

In FIG. 6, if it is determined that the sensed weight of the food does not change for a time greater than or equal to the reference time within the reference range, for example, if the sensed weight of the food is outside the reference range as in the case where the user takes the container 17 off the platform unit 16, the controller 100 determines whether the cooking start key 121 is pressed by the user, in operation 530.

If the cooking start key 121 is pressed, in operation 530, the controller 100 calculates a cooking time to correspond to the weight of the food stored in the internal memory 101, in operation 532, and displays the calculated cooking time on the display unit 140, in operation 534. The controller 100 controls the magnetron driving unit 150 to drive the magnetron 151, thus performing cooking for the calculated cooking time, in operation 536.

If the cooking start key 121 is not pressed in operation 530, the controller 100 counts a time using the counter 102, in operation 538, and determines whether the counted time is greater than or equal to a set time, for example, 10 seconds, in operation 540. If the counted time is not greater than or equal to the set time, the controller 100 returns to the determining, in operation 530, so as to continuously count a time. If the counted time is greater than or equal to the set time, the controller 100 initializes the internal memory 101 by deleting the weight of the food stored in the internal memory 101 so as to prevent a malfunction due to the carelessness of the user, in operation 542. In this case, the reason for deleting the weight of the food is to prevent a situation in which a cooking time corresponding to the weight of the food stored in the internal memory 101 is calculated and subsequent cooking is to be performed under a no load condition in which the food is not present in the cooking cavity and the user presses the cooking start key 121.

As is apparent from the above description, the present invention provides a microwave oven and method of controlling the same, which stores the weight of food in an external memory through a simple manipulation of pressing a hold key by a user, so that the user is not inconvenienced to personally memorize the weight of the food, thus increasing convenience of using the microwave.

The present invention is advantageous in that it may perform cooking by storing a recalculated weight of the food in an internal memory and calculate a cooking time depending on the stored weight of the food even if an additional setting operation using the hold key is not performed.

Further, the present invention is also advantageous in that it calibrates a zero point to sense the weight of food, so a cooking time to correspond to the weight of the food may be accurately calculated, thus increasing cooking performance.

The present invention is advantageous in that it counts a time if a cooking start key is not pressed after the weight of the food is measured, and performs initialization by deleting the stored weight of the food if the counted time exceeds a set time, thus preventing a malfunction in which cooking is performed when the user does not put the food into the cooking cavity due to carelessness of the user.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A microwave oven, comprising:

a weight sensing unit provided at an external portion of the microwave oven, to sense a weight of food;

a memory to store weight information of the food;

an input unit to set a mode to measure the weight of the food and a mode to store the measured weight of the food; and a controller to store the weight of the food measured through the weight sensing unit in the memory when the weight measurement and storage modes are set through the input unit, and to calculate a cooking time depending on the weight of the food stored in the memory when cooking is performed, wherein the controller comprises:

a counter to count a predetermined period of time for which a cooking start is not set, and deletes the weight information of the food stored in the memory when the time counted by the counter exceeds a set time.

2. A microwave oven, comprising:

a weight sensing unit provided at an external portion of the microwave oven, to sense a weight of food, wherein the weight sensing unit comprises:

a weight sensor installed in an upper portion of a body of the microwave oven, and having a fixed one end, wherein the weight sensor senses a weight of the food depending on a force applied to a free end thereof;

a memory to store weight information of the food;

an input unit to set a mode to measure the weight of the food and a mode to store the measured weight of the food; and a controller to store the weight of the food measured through the weight sensing unit in the memory when the weight measurement and storage modes are set through the input unit, and to calculate a cooking time depending on the weight of the food stored in the memory when cooking is performed.

3. The microwave oven according to claim 2, wherein the weight sensing unit further comprises:

a support bracket provided at the one end of the weight sensor to support the weight sensor;

a shaft fixed to the free end of the weight sensor to receive the force applied to the free end;

at least one heat dissipating hole provided in the weight sensor to allow the free end of the weight sensor to be bent and protected against heat; and sensing elements mounted on surfaces of a center portion of the weight sensor to contract and expand so that internal resistances thereof vary.

4. The microwave oven according to claim 3, wherein the sensing elements apply a weight sensing signal to the controller to correspond to the varied resistances.

5. A microwave oven, comprising:

a weight sensing unit provided at an external portion of the microwave oven, to sense a weight of food;

a memory to store weight information of the food;

an input unit to set a mode to measure the weight of the food and a mode to store the measured weight of the food, wherein the input unit comprises:

a first setting key to set the mode of measuring the weight of the food, and a second setting key to set the mode of storing the weight of the food, wherein the first setting key is used to set a mode of searching a previously arranged table for a calorie content of the food and to display the calorie content; and a controller to store the weight of the food measured through the weight sensing unit in the memory when the weight measurement and storage modes are set through the input unit, and to calculate a cooking time depending on the weight of the food stored in the memory when cooking is performed.

6. A microwave oven, comprising:

a weight sensing unit provided at an external portion of the microwave oven, to sense a weight of food;

a memory to store weight information of the food;

an input unit to set a mode to measure the weight of the food and a mode to store the measured weight of the food;

a controller to store the weight of the food measured through the weight sensing unit in the memory when the weight measurement and storage modes are set through the input unit, and to calculate a cooking time depending on the weight of the food stored in the memory when cooking is performed; and a platform unit mounted on the weight sensing unit to place an object filled with the food thereon, so that a weight of the object is measured by the weight sensing unit, wherein the platform unit comprises:

a platform base to integrate with a portion of the microwave oven;

a rubber seat to provide a plate to receive the object thereon and the width of the objected to be measured; and a locking ring to fix the rubber seat to the platform base.

7. A method of controlling a microwave oven having a weight sensing unit provided at an external portion of the microwave oven to sense a weight of food, the method comprising:

determining whether a weight measurement mode is set to measure a weight of the food;

determining whether a weight information storage mode is set to store weight information of the food if the weight measurement mode is set;

calibrating a zero point for the weight sensing unit;

calculating the weight of the food after the zero point calibration;

storing the calculated weight of the food measured using the weight sensing unit provided at the external portion of the microwave oven if the weight information storage mode is set;

displaying the calculated weight of the food;

calculating a cooking time to correspond to the calculated weight of the food; and performing cooking for the calculated cooking time.

8. The microwave oven control method according to claim 7, wherein the weight of the food calculated after the zero point calibration, is obtained by subtracting a weight of a container from a total weight including the weight of the container filled with the food.

9. The microwave oven control method according to claim 7, wherein the storing the calculated weight of the food is performed through a setting operation.

10. The microwave oven control method according to claim 9, wherein the operation of storing the calculated weight of the food is performed so that a change of the weight of the food is sensed even if the setting operation is not performed and the storing is carried out depending on the changed weight of the food.

11. The microwave oven control method according to claim 10, wherein the change of the weight of the food represents a change over a time greater than or equal to a preset reference time within a preset reference range.

12. A method of controlling a microwave oven having a weight sensing unit provided at an external portion of the microwave oven to sense a weight of food, the method comprising:

determining whether a weight measurement mode is set to measure a weight of the food;

determining whether a weight information storage mode is set to store weight information of the food if the weight measurement mode is set;

storing a weight of the food measured using the weight sensing unit provided at the external portion of the microwave oven if the weight information storage mode is set;

determining whether a cooking start is set to perform cooking;

calculating a cooking time to correspond to the stored weight of the food if the cooking start is set;

performing cooking for the calculated cooking time;

counting a time in which the cooking start is not set; and deleting the stored weight of the food to prevent a malfunction if the counted time exceeds a preset time.

13. A microwave oven, comprising:

a weight sensing unit to sense a weight of food;

a memory to store weight information of the food;

an input unit to set a mode to measure the weight of the food and a mode to store the measured weight of the food; and a controller to store the weight of the food measured through the weight sensing unit in the memory when the weight measurement and storage modes are set through the input unit, and to calculate a cooking time depending on the weight of the food stored in the memory when cooking is performed, wherein the controller comprises:

a counter to count a predetermined period of time for which a cooking start is not set, and deletes the weight information of the food stored in the memory when the time counted by the counter exceeds a set time.

14. A microwave oven, comprising:

a weight sensing unit to sense a weight of food, wherein the weight sensing unit comprises:

a weight sensor installed in an upper portion of a body of the microwave oven, and having a fixed one end, wherein the weight sensor senses a weight of the food depending on a force applied to a free end thereof;

a memory to store weight information of the food;

an input unit to set a mode to measure the weight of the food and a mode to store the measured weight of the food; and a controller to store the weight of the food measured through the weight sensing unit in the memory when the weight measurement and storage modes are set through the input unit, and to calculate a cooking time depending on the weight of the food stored in the memory when cooking is performed.

15. The microwave oven according to claim 14, wherein the weight sensing unit further comprises:

a support bracket provided at the one end of the weight sensor to support the weight sensor;

a shaft fixed to the free end of the weight sensor to receive the force applied to the free end;

at least one heat dissipating hole provided in the weight sensor to allow the free end of the weight sensor to be bent and protected against heat; and sensing elements mounted on surfaces of a center portion of the weight sensor to contract and expand so that internal resistances thereof vary.

16. The microwave oven according to claim 15, wherein the sensing elements apply a weight sensing signal to the controller to correspond to the varied resistances.

17. A microwave oven, comprising:

a weight sensing unit to sense a weight of food;

a memory to store weight information of the food;

an input unit to set a mode to measure the weight of the food and a mode to store the measured weight of the food, wherein the input unit comprises:

a first setting key to set the mode of measuring the weight of the food, and a second setting key to set the mode of storing the weight of the food, wherein the first selling key is used to set a mode of searching a previously arranged table for a calorie content of the food and to display the calorie content; and a controller to store the weight of the food measured through the weight sensing unit in the memory when the weight measurement and storage modes are set through the input unit, and to calculate a cooking time depending on the weight of the food stored in the memory when cooking is performed.

18. A microwave oven, comprising:

a weight sensing unit to sense a weight of food;

a memory to store weight information of the food;

an input unit to set a mode to measure the weight of the food and a mode to store the measured weight of the food;

a controller to store the weight of the food measured through the weight sensing unit in the memory when the weight measurement and storage modes are set through the input unit, and to calculate a cooking time depending on the weight of the food stored in the memory when cooking is performed; and a platform unit mounted on the weight sensing unit to place an object filled with the food thereon, so that a weight of the object is measured by the weight sensing unit, wherein the platform unit comprises:

a platform base to integrate with a portion of the microwave oven, a rubber seat to provide a plate to receive the object thereon and the width of the objected to be measured, and a locking ring to fix the rubber seat to the platform base.

19. A method of controlling a microwave oven having a weight sensing unit to sense a weight of food, the method comprising:

determining whether a weight measurement mode is set to measure the weight of the food;

determining whether a weight information storage mode is set to store weight information of the food if the weight measurement mode is set;

calibrating a zero point for the weight sensing unit;

calculating the weight of the food after the zero point calibration;

storing the calculated weight of the food measured using the weight sensing unit if the weight information storage mode is set;

displaying the calculated weight of the food;

calculating a cooking time to correspond to the calculated weight of the food; and performing cooking for the calculated cooking time.

20. The microwave oven control method according to claim 19, wherein the weight of the food calculated after the zero point calibration, is obtained by subtracting a weight of a container from a total weight including the weight of the container filled with the food.

21. The microwave oven control method according to claim 19, wherein the storing the calculated weight of the food is performed through a setting operation.

22. The microwave oven control method according to claim 21, wherein the operation of storing the calculated weight of the food is performed so that a change of the weight of the food is sensed even if the setting operation is not performed and the storing is carried out depending on the changed weight of the food.

23. The microwave oven control method according to claim 22, wherein the change of the weight of the food represents a change over a time greater than or equal to a preset reference time within a preset reference range.

24. A method of controlling a microwave oven having a weight sensing unit to sense a weight of food, the method comprising:

determining whether a weight measurement mode is set to measure a weight of the food;

determining whether a weight information storage mode is set to store weight information of the food if the weight measurement mode is set;

storing a weight of the food measured using the weight sensing unit if the weight information storage mode is set;

determining whether a cooking start is set to perform cooking;

calculating a cooking time to correspond to the stored weight of the food if the cooking start is set;

performing cooking for the calculated cooking time;

counting a time in which the cooking start is not set; and deleting the stored weight of the food to prevent a malfunction if the counted time exceeds a preset time.

* * * * *

UNITED STATES PATENT AND TRADEMARK OFFICE

CERTIFICATE OF CORRECTION

PATENT NO. : 6,894,258 B2
DATED : May 17, 2005
INVENTOR(S) : Yun-Bong Chun

It is certified that error appears in the above-identified patent and that said Letters Patent is hereby corrected as shown below:

Column 10,
Line 44, change “selling” to -- setting --.

Signed and Sealed this

Seventh Day of March, 2006

JON W. DUDAS
*Director of the United States Patent and Trademark Office*